United States Patent [19]

Theurer

[11] 4,258,627

[45] Mar. 31, 1981

[54] BALLAST TAMPING

[75] Inventor: Josef Theurer, Vienna, Austria

[73] Assignee: Franz Plasser Bahnbaumaschinen-Industriegesellschaft m.b.H., Vienna, Austria

[21] Appl. No.: 855,873

[22] Filed: Nov. 30, 1977

Related U.S. Application Data

[63] Continuation-in-part of Ser. No. 770,901, Feb. 22, 1977, abandoned.

[30] Foreign Application Priority Data

Jun. 9, 1976 [AT] Austria ..... 4219/76
Dec. 14, 1976 [AT] Austria ..... 9256/76

[51] Int. Cl.[3] ..... E01B 27/16
[52] U.S. Cl. ..... 104/12
[58] Field of Search ..... 104/12, 7 R, 7 B

[56] References Cited

U.S. PATENT DOCUMENTS

| | | | |
|---|---|---|---|
| 3,357,366 | 12/1967 | Theurer | 104/12 |
| 3,534,687 | 10/1970 | Plasser et al. | 104/12 |
| 3,669,025 | 6/1972 | Plasser et al. | 104/12 |
| 3,998,165 | 12/1976 | Jaeggi | 104/12 |
| 4,069,763 | 1/1978 | Theurer | 104/12 |
| 4,094,251 | 6/1978 | Theurer | 104/7 R X |

FOREIGN PATENT DOCUMENTS

| | | | |
|---|---|---|---|
| 256588 | 1/1964 | Australia | 104/12 |
| 938498 | 12/1973 | Canada | 104/12 |
| 830352 | 2/1952 | Fed. Rep. of Germany | 104/12 |
| 1366286 | 6/1964 | France | 104/12 |

*Primary Examiner*—Randolph A. Reese
*Attorney, Agent, or Firm*—Kurt Kelman

[57] ABSTRACT

A tamping unit comprises a vertically adjustably mounted carrier, a plurality of tamping tools arranged in a transverse plane for immersion in a track crib on each side of the rail, a rigid integral support including a central arm mounted on the carrier and two transverse arms extending perpendicularly to the track rail from the central arm on a respective side of the rail, the support being mounted on the carrier for pivoting about an axis extending transversely of the rail and the tamping tools being mounted on the transverse support arms on the respective sides of the rail to straddle the rail, drives for pivoting the support about the axis for vibrating the support, and a pivot mounting one of the tamping tools mounted on the transverse support arm extending from the rail towards the center of the track, the pivot extending parallel to the track rail for pivoting the tamping tool independently in a direction transverse to the track rail.

5 Claims, 9 Drawing Figures

BALLAST TAMPING

This is a continuation-in-part application of my U.S. patent application Ser. No. 770,901, filed Feb. 22, 1977, now abandoned.

The present invention relates to improvements in a tamping unit for tamping ballast under a tie supporting a track rail, especially for operation at track switches and rail crossings, and to a mobile tamping machine incorporating such tamping units.

U.S. Pat. No. 3,000,328, dated Sept. 19, 1961, discloses a tamping unit for use in a mobile track tamping machine, which comprises a tamping tool carrier vertically adjustably mounted on a pair of guide columns and two pairs of tamping tools mounted on the carrier and arranged thereon to straddle the track rail. Each of the tamping tools consists of a holder part and a tool part replaceably fixed in the holder part, and the pairs of tamping tools form a pincer adapted to straddle a respective one of the ties. Each holder part of the pair of tamping tools is connected to drives for vibrating and reciprocating the tamping tools of each pair in the direction of the track rail and with respect to the tie the pair of tamping tools straddles, the tamping tool parts being immersible in the ballast upon vertical adjustment of the carrier. While tamping units of this type have been successfully and extensively used in commercial track tamping operations all over the world, the strenuous operating conditions to which they are subjected severely limit their operating life. The forces transmitted from the tamping tools to the vibrating and reciprocating drives are very powerful and frequently uneven, thus causing severe and often non-uniform wear of the bearings and drives, al of which shortens the operating life of the unit.

Ballast tamping machines designed to work along regular track generally have only limited usefulness for tamping ballast in track sections which include track switches, rail crossings or track branches since the work of the tamping tools is hindered by structural track elements impairing their immersion in the ballast. Various structures have been proposed to solve this problem and to provide tampers useful in track switches and rail crossings but they have only been partially successful.

An important advance was achieved by the switch tamper disclosed in British Pat. No. 957,268, published May 6, 1964, which discloses a reciprocable tamping tool whose upper portion is connected to a reciprocating drive for reciprocating the tool in the direction of the track rail while its lower portion is pivotal in a vertical plane extending transversely to the track rail. Such a tool is useful in a tamping unit for operation in switches or rail crossings where it may be desired to swing the tool out of the way. If the tamping tools of the tamping unit hereinabove described are modified in this manner, the operating life of the unit is further reduced, due to the additional and uneven forces exerted by such pivotal tools.

British Pat. No. 1,037,520, published July 27, 1966, discloses similar apparatus wherein a pair of tamping tools as a unit is pivotal transversely away from the associated rail.

Further progress was made with the mobile tamper disclosed in U.S. Pat. No. 3,534,687, dated Oct. 20, 1970, which comprises a tamping unit wherein two successive cooperating groups of tamping tools are mounted on a vertically adjustable carrier which is movable on the machine frame transversely of the track. A pair of tamping tools are mounted on the carrier to straddle the associated rail as the tamping tools are immersed in the crib and each tamping tool, in addition to being reciprocable in the direction of the rail towards and away from the adjacent tie, and being vibratory, is also mounted for pivoting towards and away from the associated rail in a plane parallel to the tie. This tamper can be used for simultaneously tamping more than one tie not only in regular track sections but it may also be used as a switch tamper and in rail yards because pivoting the tamping tools away from the associated rail will obviate any obstacle encountered while their pivoting towards the rail will enable the tamping tools to be used for tamping ballast under the adjacent ties.

U.S. Pat. No. 3,653,327, dated Apr. 4, 1972, discloses a mobile track tamping machine wherein independently vertically movable tamping units are mounted in association with each track rail on each side of the rail. Each tamping unit has a pair of cooperating tamping tools respectively immersible in two successive cribs and the tools are reciprocable towards and away from the tie between the two cribs. The upper end of each tamping unit is suspended from an overhanging portion of the machine frame and the lower end thereof is adjustably guide transversely to the track. This mobility of the tamping unit enables the tamping tools at least partially to avoid obstacles in the working area by swinging the unit laterally out of the way. However, since the tamping tools of each unit can be swung laterally only together, an individual adjustment of the tools is not possible. Furthermore, the various pivotal bearings and relatively complex guides increase the cost of the structure and maintenance.

It is the primary object of this invention to provide a tamping unit and a mobile ballast tamping machine useful for tamping ballast in regular track section and very simply adaptable to work in track switches and rail crossings for tamping larger areas of ballast under the latter conditions than has been possible with heretofore known switch tampers.

It is a concomitant object of the invention to provide a tamping unit with tamping tools which may be individually disposed so as to avoid obstacles in the track structure or to be operated for tamping.

Another object of the present invention is a tamping unit of this type which is robust, exchangeably useful in regular track and track switches, and of simple, light and compact structure requiring a minimum of maintenance.

The above and other objects are accomplished in accordance with this invention by a tamping unit for tamping ballast under a tie supporting a track rail, adjacent ones of the ties defining cribs therebetween, which comprises a vertically adjustably mounted carrier, a plurality of tamping tools arranged in a plane extending transversely of the track rail for immersion in a respective one of the cribs on each side of the rails, a supporting mounting the tamping tools on the carrier, the support being mounted on the carrier for pivoting about an axis extending transversely of the track rail, a drive for pivoting the support about the axis whereby the tamping tools are reciprocated in the direction of the track rail, a drive for vibrating the support, and a pivot mounting at least one of the tamping tools on the support, the pivot extending substantially parallel to the track rail for pivoting the tamping tool mounted on the pivot independently in a direction transverse to the track rail. The support preferably is a rigid integral support including a central arm mounted on the carrier and two transverse arms extending perpendicularly to the track rail from the central arm on a respective side of the track rail, the tamping tools being mounted on the transverse support arms on the respective sides of the track rail to straddle the rail, and the pivotal tamping tool being mounted on the transverse support arm extending from the rail towards the center of the track.

According to another aspect of the invention, there is provided a mobile machine for tamping ballast under a tie supporting a rack including two rails, adjacent ones of the ties defining cribs therebetween, which comprises a machine frame mounted for mobility on the track, and a tamping unit associated with each of the track rails. Each tamping unit includes a carrier vertically adjustably mounted on the machine frame above the associated rail, a plurality of tamping tools arranged in respective planes extending transversely of the track for immersion in the cribs on each side of the tie and on each side of the associated rail, a respective support for each of the pluralities of tamping tools arranged in the respective planes, the supports mounting the tamping tools and being mounted on the carrier for pivoting about axes extending transversely of the track, a common drive for pivoting the supports about the axes whereby the tamping tools are reciprocated in cooperating pairs in the direction of the track, a common drive for vibrating the supports, and a pivot mounting at least one of the tamping tools on each one of the supports on the side of the rail facing the center of the track, the pivots extending substantially parallel to the track rail for pivoting the tamping tools mounted on the pivots independently in a direction transverse to the track rail.

This arrangement is very simple and robust. It enables ballast tamping to be effected in regular track sections as well as in most parts of track switches and rail crossings while permitting full adaptation to the operating conditions in such areas. Operating a mobile tamper with such tamping units makes it possible to obtain a uniform quality of tamping and to reduce any manual spot tamping that may be required at track switches to a minimum, or to avoid it altogether.

The structure in accordance with the present invention takes into account the fact that the structural track parts obstructing tamping are usually disposed on the same side of the track rail associated with the tamping unit so that only the tamping tool or tools on this side of the rail need be mounted for pivoting away from the rail transversely of the track. Since the tamping tools are independently pivotal, individual tamping tools may be pivoted transversely of the track if and as the need arises, taking full account of the direction and the size of obstructing track parts which may be in the way of individual tamping tools.

Compared with known switch tampers wherein all tamping tools are pivotal transversely to the track, the structure according to this invention is simpler and more compact. The tamping units of the invention may be readily built into existing mobile tampers without requiring substantial structural changes in the machine frame.

In the preferred embodiment, a single vibrating and reciprocating drive is required for operating the tamping tool pairs on each side of the rail. Furthermore, the rigid integral central arm/transverse arms support assures almost rattle-free transmission of the reciprocating forces and a closed force transmission path so that the drives will transmit their vibrating and reciprocating forces evenly and substantially undiminished to the tamping tool parts immersed in the ballast, even if individual tamping tools are swung out of the way at switches or rail crossings, thus assuring better tamping quality at such track points which have always been difficult to tamp effectively. In addition, the rigid support assures more uniform and effective transmission of the tamping force to all the tools, thus increasing the effectiveness of the machine. A rigid integral support for a plurality of tamping tools has the particular advantage that it may be sufficiently rigid to absorb asymmetrical loads to which they will be subjected during tamping operations in track switches and rail crossings. The formation of a central arm from which two transverse arms project enables the operator to have a clear view of the tamping tools as they are immersed in the cribs, which is of particular advantage during the tamping operation in track switches and rail crossings to avoid damage to structural track parts by the immersing tamping tools.

The above and other objects, advantages and features of the invention will become more apparent from the following detailed description of a now preferred embodiment thereof, taken in conjunction with the accompanying drawing wherein FIG. 1 shows an end-elevational view, seen in the direction of arrow I of FIG. 2, of one embodiment of a tamping unit arranged to tamp the ballast under a tie in the region where the track rail intersects, i.e. is supported on, the tie;

Figure 1:
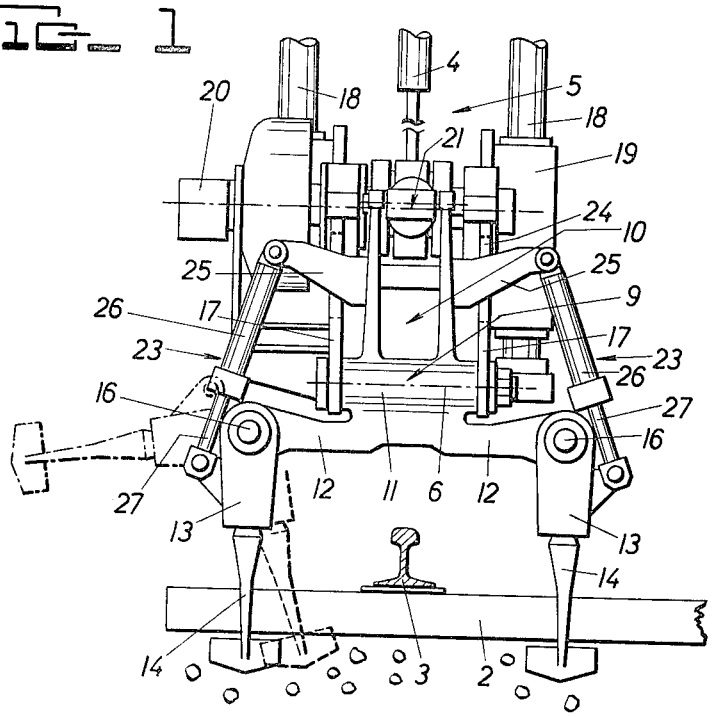
Figure 2:
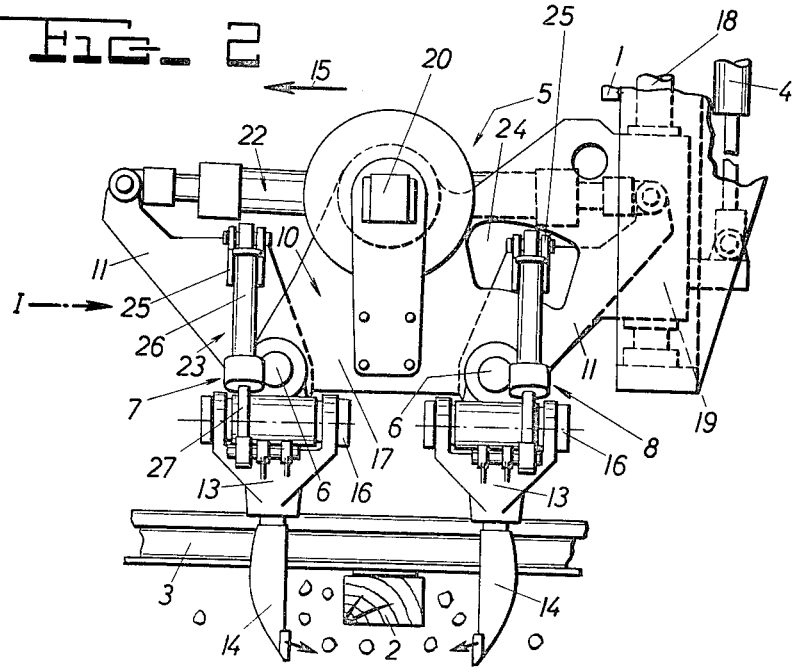
FIG. 2 is a side elevational view ot the tamping unit, also illustrating the vertical adjustment arrangement, the unit carrier being shown in the lowered position wherein the tamping tools are immersed in the ballast.

Referring now to the drawing and first to FIGS. 1 and 2, tamping unit 5 is shown to comprise carrier 10 vertically adjustably mounted on fragmentarily and diagrammatically indicated machine frame 1 of a mobile track tamper mounted for mobility on a track consisting of ties 2 supporting track rails 3. The track rests on ballast. Two pairs 7 and 8 of tamping tools are mounted on the carrier and each pair of tools is arranged to straddle the track rail, as shown in FIG. 1. The pairs of tools form pincers adapted to straddle a respective tie 2, as shown in FIG. 2. In operation and during vibration and reciprocation, these pairs of tamping tools cooperate in a well known manner to tamp the ballast under the intersection of a tie and rail so as to provide firm supports for the track.

A rigid integral support 9 mounts each pair of tamping tools on carrier 10. The support is substantially T-shaped and is comprised of central pivotal support arm 11 mounted on the carrier for pivoting about transverse axis 6 extending substantially perpendicularly to track rail 3 and substantially parallel to the plane of the track, i.e. a horizontal axis about which the support arm may pivot in a vertical plane passing through the track rail, and two transverse arms 12 extending perpendicularly to track rail 3 from central pivotal support arm 11 in opposite directions on a respective side of the track rail. Pivot 16 mounts each tamping tool holder part 13 on a respective transverse arm 12, the pivot extending substantially parallel to track rail 3 in the direction of arrow 15 for pivoting each tamping tool independently in a direction transverse to the track rail (see broken and chain-dotted lines in FIG. 1), i.e. to enable each tamping toool to be swung about a horizontal axis in a vertical plane extending perpendicularly to the track rail.

In the embodiment illustrated in FIGS. 1 and 2, the tamping unit carrier comprises a pair of mounting plates 17 straddling track rail 3 and transverse bracing elements rigidly interconnecting the mounting plates. Central pivotal support arms 11 are pivotally mounted at 6 on mounting plates 17. A pair of guide columns 18 mount carrier 10 vertically adjustably on machine frame 1, for which purpose each mounting plate 17 has guide element 19 associated with a respective guide column for vertical gliding movement therealong. The guide elements project from their mounting plates in a direction opposite to the operating direction of the mobile tamper, indicated by arrow 15. Hydraulic drive 4 connects the guide elements to the machine frame for vertically moving the carrier.

The illustrated drive for vibrating the tamping tools comprises crank drive 21, i.e. an eccenter shaft, mounted centrally on the carrier between the mounting plates 17 and motor 20 driving the crank drive, the driving motor being mounted on one of the mounting plates and arranged outside the space between the mounting plates. The illustrated drives for reciprocating the tamping tools of each pair in the direction of the track rail and with respect to the tie the pair of tamping tools straddles are hydraulic motors 22 extending in a vertical plane passing through the track rail. The cylinders of hydraulic motors 22 are associated with crank drive 21 for vibration thereby in a well known manner while the piston rods of these motors are linked to the upper ends of pivotal support arms 11. In this manner, the tamping tools are vibrated and may be reciprocated for tamping the ballast.

This arrangement has not only the advantage that the amplitude of vibrations is transmitted substantially unchanged from the crank driven through the support and the tamping tool holders to tamping tool parts 14, which are replaceably fixed in the holders and whose jaws are immersed in the ballast, but also provides a simple structure which is easy to maintain. The construction is compact and sturdy, and the power transmission has a minimum of elements. Eccentric loads on the pivots are avoided, which reduces the wear on the bearings, and the distribution of forces is very advantageous, even when some of the tamping tools are swung out of their tamping position.

For pivoting each tamping tool independently in a transverse direction, as may be required at switches or rail crossings, drives 23 are connected between each support arm 11 and a respective tamping tool holder part 13. In the illustrated embodiment, drives 23 are hydraulic motors comprising cylinder 26 and piston rod 27, the piston rod being linked to a small bracket on tamping tool holder part 13. A pair of spacing members constituted by brackets 25 project from each support arm 11 and cylinder 26 is linked to a respective bracket. As best shown in FIG. 2, each mounting plate 17 defines opening 24 in the area adjacent guide columns 18 to permit cylinders 26 of drives 23 to extend therethrough to pass from support arm 11 to the tamping tool holder parts.

While individual drives 23 may be fed from a common hydraulic fluid source, they enable each tamping tool to be swung out independently and individually in a rapid manner into any desired pivotal position. Providing spacing brackets 25 to support the cylinders of pivoting drives 23 and linking the piston rods of the drives to the tamping tool holder parts provides a very compact structure requiring a minimum of space.

Pairs 7 and 8 of the tamping tools, each of which straddles track rail 3, are arranged mirror-symmetrically with respect to a vertical plane passing through the tie which is straddled by the pairs of tools. This symmetrical arrangement permits a transmission of forces free of play and a substantially closed flow of power between the point of immersion of tamping tool parts 14 in the ballast to vibrating and reciprocating drives 21 and 22, avoiding any substantial reduction in the amplitude of vibrations between the crank drive and the vibrating tamping tools or in the moving power between the reciprocating drive and the tools. This condition remains substantially unchanged even when any of the individual tamping tools are swung out of the ballast, which enables the ballast compaction in such difficult track areas as switches and rail crossings to be improved.

Figure 4:
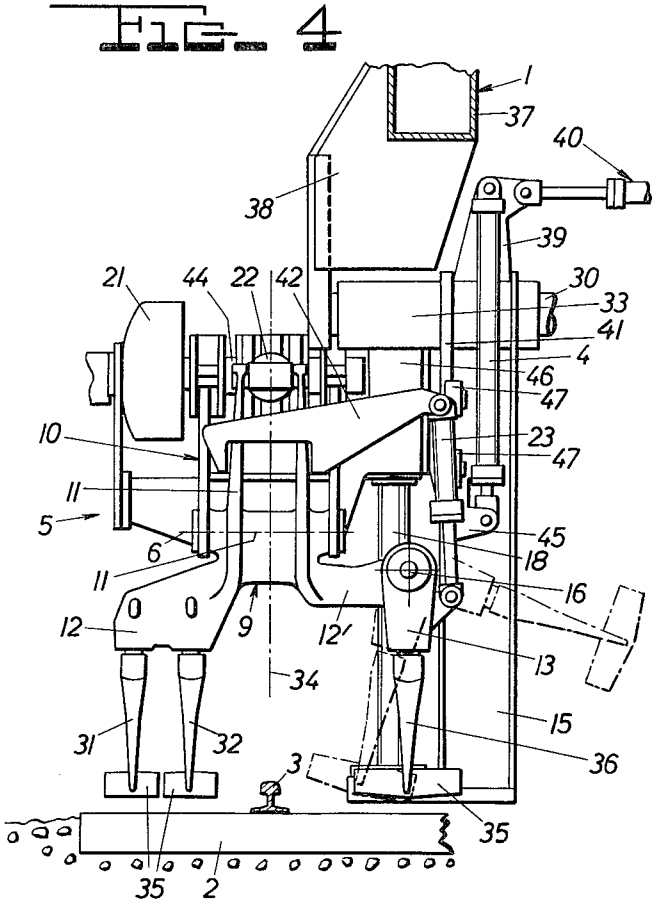
FIG. 4 is an end-elevational view of the tamping unit of FIG. 3, seen in the direction of track elongation and partly in a section along line IV—IV of FIG. 3.
Figure 3:
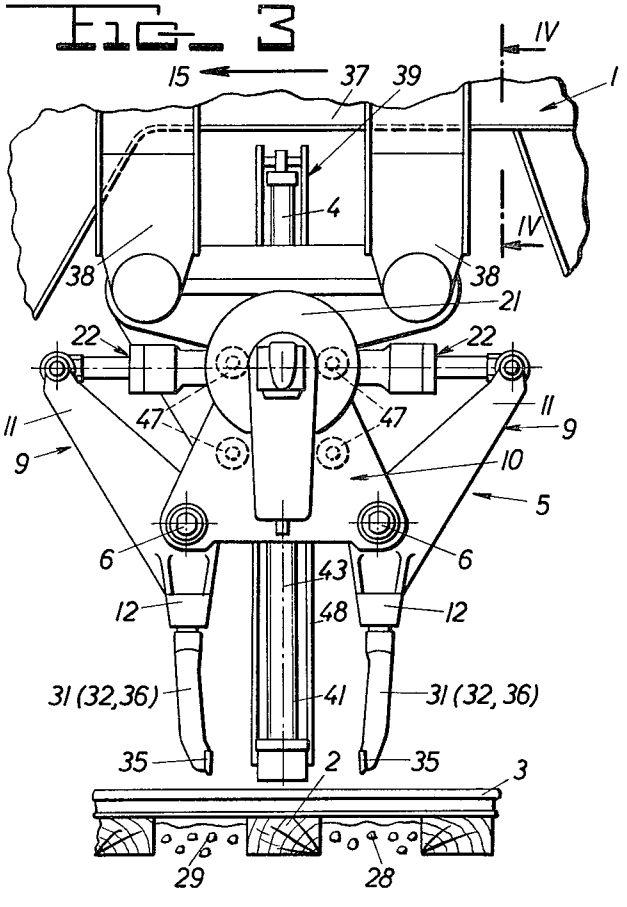
FIG. 3 is a view similar to that of FIG. 2, showing another embodiment of a tamping unit according to this invention.

To avoid redundancy in the description, like references numerals designate like parts operating in an equivalent manner in the tamping units of FIGS. 3 and 4. This tamping unit comprises vertically adjustably mounted carrier 10, a plurality of tamping tools 31, 32 and 36 arranged in a plane extending transversely of track rail 3 for immersion in respective cribs 28 and 29 on each side of the rail. Supports 9 mount each group of tamping tools 31, 32 and 36 on carrier 10 and each support is mounted on the carrier for pivoting about axis 6 extending transversely of track rail 3. Drive 22 for pivoting each support 9 about axis 6 enables the tamping tools to be reciprocated in the direction of the track rail. Vibrating drive 21 is mounted centrally between supports 9 for vibrating the supports. Pivot 16 extending substantially parallel to track rail 3 mounts tamping tool 36 on its support 9 for pivoting the tamping tool mounted thereon in a direction transverse to the track rail, as indicated in the selected pivotal positions shown in dash-and-dot lines in FIG. 4.

In the illustrated embodiment, tamping unit 5 is mounted on elongate truss 37 of fragmentarily shown frame 1 mounted for mobility on the track and forming part of a mobile machine for tamping ballast under ties 2 including two rails 3, adjacent ones of the ties defining therebetween cribs 28 and 29. One of machine frame trusses 37 is arranged above each rail and the trusses extend in the direction of the rails indicated by arrow 15 and are capable of mounting one or more tamping units. Two brackets 38 are affixed, for instance by welding, to each truss 37 on the side thereof facing outwardly, the brackets being spaced from each other in the direction of the rail and the brackets on the trusses 37 being aligned in a direction transverse to the rails, thus forming two pairs of transversely aligned brackets. A horizontal guide bar 30 extends between the brackets of each pair and is affixed thereto. Guide and support sleeves 33 glidably mount tamping unit 5 on the guide bars for transverse adjustment with respect to the track. Bracket or joist 39 is affixed to guide and support sleeves 33 and one end of hydraulic motor 40 is linked to the joist, the other end thereof being linked to machine frame 1 (in a manner not shown in the drawing), this motor constituting a drive for transversely adjusting tamping unit 5 in relation to track rail 3. Vertical guide column 18 is mounted between guide and support sleeves 33, and is affixed thereto, and tamping tool carrier 10 of the tamping unit has a guide and support sleeve 46 which vertically adjustably mounts the carrier on guide column 18. The side of tamping tool carrier 10 facing towards the center of the track carries four guide rollers 47 rotatable about axes extending parallel to each other and perpendicularly to rail 3, the rollers running along vertical guide rail 41 affixed to guide sleeves 33 to enable the carrier 10 to be moved up and down along guide column 18 by means of hydraulic drive 4 whose lower end is linked to bracket 45 on carrier 10 while its upper end is linked to bracket 39.

The tamping tool carrier has been described in connection with the embodiment of FIGS. 1 and 2. It is comprised substantially of a pair of mounting plates straddling the track rail and parallel to plane of symmetry 34 extending through rail 3 and transverse bracing elements rigidly interconnecting the mounting plates. A pair of tamping tool supports 9 are mounted on the carrier symmetrically with respect to a vertical plane of symmetry 43 of tamping unit 5, and each support is pivotal about axis 6 extending in a direction perpendicular to rail 3 and parallel to tie 2. Also as described in connection with the embodiment of FIGS. 1 and 2, each support is comprised of central pivotal support arm 11 mounted on pivot 6 and two transverse arms 12 extending perpendicularly to track rail 3 from central pivotal support arm 11 in opposite directions on a respective side of the track rail.

As can best be seen in FIG. 4, the transverse support arms projecting outwardly of the track carry a pair of tamping tools 31 and 32, and these tamping tools are stationarily mounted on the support arm. Thus, the pairs of tamping tools 31, 32 can be immersed in adjacent cribs 28 and 29 for reciprocation therein in the direction of rail 3 towards and away from tie 2 but these outer tamping tools are not mounted pivotally on the support arm. On the other hand, the transverse support arms of supports 9 projecting inwardly towards the center of the track carry tamping tool 36 in transverse alignment with outer tamping tools 31, 32 but inner tamping tool 36 is mounted pivotally on the transverse support arm, pivot 16 for the inner tamping tool extending parallel to track rail 3 in the direction of arrow 15 for enabling these inner tamping tools to be pivoted independently towards and away from track rail 3 (see chain-dotted lines in FIG. 4). For this purpose, hydraulic drive 23 has one end linked to a bracket extending from tool holder 13 of the inner tamping tool while another end of the drive is linked to bracket 42 affixed to central pivotal arm 11 of the tamping tool support. All the tamping tools are replaceably mounted in tamping tool holders and have tamping jaws 35 at their lower ends, as is conventional. Only a single inner tamping tool being provided, the tamping jaws on tamping tools 36 are wider than those on outer tamping tools 31, 32.

As also described in connection with FIGS. 1 and 2, a pair of hydraulic drives 22 are connected to the tamping tool supports for reciprocating the same, a common vibrating drive 21 including eccenter shaft 44 being mounted centrally on the carrier between the mounting plates thereof.

The operation of the tamping unit will be obvious from the above description of its structure and has been explained in connection with the embodiment of FIGS. 1 and 2. Since the pair of outer tamping tools 31, 32, with their relatively large working areas of their tamping jaws 35, operate in the region of the tie ends, reciprocation of these cooperating pairs of tools will provide a particularly effective compaction of the ballast in this region. The cooperating single inner tamping tools 36, with their tamping jaws 35 providing a smaller working area, will exert less tamping pressure in their region of the ballast, which is desirable because more compact ballast support for the tie ends than the tie center will prevent "riding" of the tie.

The symmetrical arrangement of the tamping unit and the pivotal arrangement of the inner tamping tools on the tamping tool supports of the unit have the advantage that both tracks of a track switch can be tamped with a mobile tamper incorporating such a unit without turning the machine around, the symmetrical construction assuring proper balance and a high stability, the machine frame being subjected to substantially symmetrical forces during tamping.

Figure 5:
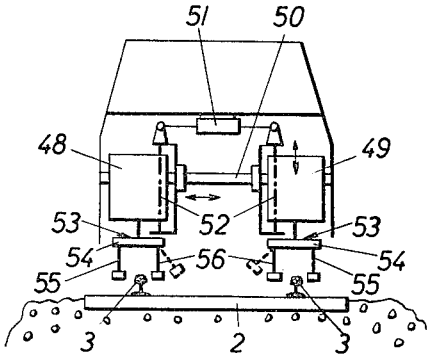
FIG. 5 is a schematic end-elevational view, on a smaller scale, of the portion of a mobile ballast tamping machine whereon the tamping units are mounted.

FIG. 5 schematically illustrates a mobile track tamper with two tamping units 48 and 49 respectively associated with track rails 3, the tamping units being mounted on horizontally extending transverse guide boom 50 for independent transverse adjustment with respect to the rails by means of hydraulic drive 51. Each tamping unit is mounted for independent vertical adjustment on vertical guide column 52. The tamping tool supports 53 have transverse support arms 54 holding tamping tools 55 and 56. The tamping units are substantially the same as hereinabove described but they have only a single outer tamping tool 55, i.e. the inner and outer tamping tools are entirely symmetrical. Such a tamper can be used not only in regular track sections but also for tamping both rails at track switches, rail crossings and the like, where inner tamping tool 56 is selectively pivoted out of the way of any obstructions along the track structure.

Figure 6:
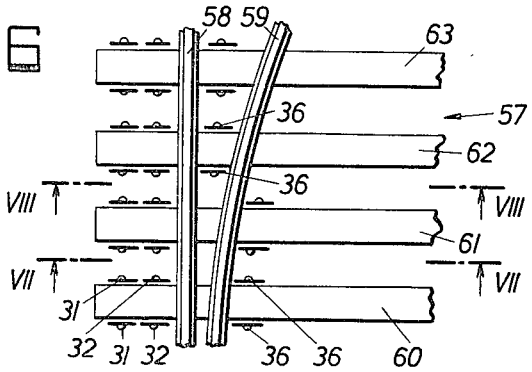
FIG. 6 is a top view of a portion of a track switch, schematically illustrating the immersion of the tamping tools of the tamping unit of FIGS. 3 and 4 in the ballast.
Figure 7:
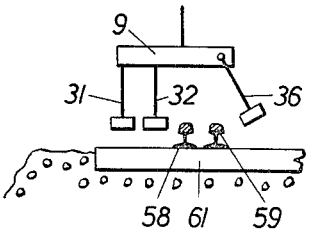
FIG. 7 is a schematic end-elevational view of the operational position of the tamping tools in the region VII—VII of FIG. 6.
Figure 8:
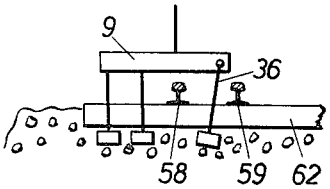
FIG. 8 is a like view of the operational position of the tamping tools in the region VIII—VIII of FIG. 6.

FIGS. 6 to 8 show the operation of a tamping unit of the type described hereinabove in connection with FIGS. 3 and 4 in the region of track switch 57, only outer rail 58 of the main track and curvilinearly extending rail 59 of a track branching off the main track being shown. As the tamper proceeds successively from tie 60 to tie 63 of track switch 57, the pair of outer tamping tools 31, 32 remains in the same position on supports 9 at each tie. On the other hand, tamping tools 36 are first swung inwardly as ties 60 and 61 are tamped while they are pivoted outwardly for tamping tie 62 between diverging rails 58 and 59. At tie 63, the two rails are far enough apart to permit tamping tools 36 to be repositioned in their normal position used for tamping straight track.

Figure 9:
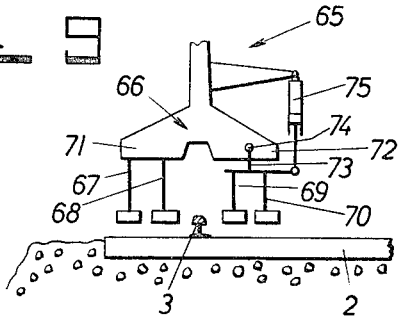
FIG. 9 is a schematic end-elevational view of another embodiment of a tamping unit according to the invention.

In tamping unit 65 of FIG. 9, integral rigid tamping tool support 66 again has transverse support arms 71 and 72, each of the support arms carrying a pair of tamping tools 67, 68 and 69, 70, respectively, the pairs of tools symmetrically straddling track rail 3 supported on ties 2. While outer tamping tools 67 and 68 are stationarily mounted on transverse support arm 71, i.e. they are movable only by reciprocation of support 66 in the direction of track rail 3 towards and away from tie 2, tamping tool holder 73 carries inner tamping tools 69, 70 on transverse support arm 72. The tamping tool holder is mounted on transverse support arm 72 by pivot 74 extending in a direction parallel to rail 3 for pivoting the tamping tool holder in a transverse plane towards and away from the track rail, hydraulic drive 75 being connected to tamping tool holder 73 for pivoting it in this plane and thus to enable the inner tamping tools to be selectively moved in relation to any obstructing track parts in a track switch or the like.

Various modifications of the illustrated embodiment will readily occur to those skilled in the art. For instance a plurality of such tamping units may be used for tamping ballast under a tie, such tamping units being transversely movable with respect to the track elongation, singly or in unison. Also, while hydraulic drives have been shown and described, any suitable drive may be used, such as spindle-and-nut drives. However, hydraulic drives have been found very effective not only as far as operating life of such drives is concerned but also in their effective power transmission to vibratory tamping tools. The rigid integral tamping tool support may be a cast iron part or a welded structure.

Furthermore, the principle of a differential compaction of the ballast regions to the left and right of each track rail to avoid tie "riding" and thus to improve the quality of the tamping may be effectuated not only by a variation in the number and distribution of the outer and inner tamping tools on each tamping tool support but also by variations in the effective working areas of the tamping jaws of the respective tools. The number of tools and the tamping jaw configurations may be readily adapted to local operating conditions and, since all the tamping tools are replaceably mounted in their holders, the machine may be adapted to a great number of working conditions with a minimum of effort and time.

What is claimed is:

1. A tamping unit for tamping ballast under a tie supporting a track rail, adjacent ones of the ties defining cribs therebetween, comprising (a) a vertically adjustably mounted carrier, (b) a plurality of tamping tools arranged in a plane extending transversely of the track rail for immersion in a respective one of the cribs on each side of the rail in respective groups straddling the rail, each group comprising at least one tamping tool, (c) a pair of rigid integral supports, each one of the supports including a central pivotal support arm mounted on the carrier for pivoting about a transverse axis extending substantially perpendicularly to the track rail and substantially parallel to the plane of the track, and two transverse arms extending perpendicularly to the track rail from each central pivotal arm on a respective side of the track rail, the tamping tools being mounted on the transverse arms of each integral support on the respective sides of the track rail to straddle the rail and respective ones of the tamping tools being mounted on the pair of supports in pairs of tools forming a pincer straddling a respective one of the ties disposed between the pairs of tools, the tool or tools of one of said groups on one side of the rail being mounted stationarily on a respective one of the transverse arms, the central pivotal support arms mounting the supports on the carrier for pivoting about the transverse axis, (d) one drive for pivoting each support about the transverse axis connected to the central pivotal support arms whereby the tamping tools are reciprocated in the direction of the track tie straddling the one tie, (e) a common drive for vibrating the supports connected to the pivoting drives for vibrating the reciprocating tamping tools mounted on the supports in common, and (f) a pivot mounting each tamping tool or tools of the other group on the other side of the rail on a respective one of the other transverse arms, the pivot extending substantially parallel to the track rail for pivoting the tamping tool or tools mounted on the pivot independently in a direction transverse to the track rail.

2. The tamping unit of claim 1, wherein the carrier comprises a pair of mounting plates straddling the track rails, the supports being pivotally mounted on the mounting plates, the common drive for vibrating the supports comprises a crank drive mounted centrally on and between the mounting plates and a motor driving the crank drive, the driving motor being arranged outside the space between the mounting plates.

3. The tamping unit of claim 2, wherein the drive for pivoting each support is connected between the pivotal support arm of each support and the crank drive, the pivoting drives extending in a vertical plane passing through the track rail.

4. The tamping unit of claim 1, further comprising a drive connected to each pivotal tamping tool for pivoting said pivotal tamping tool independently.

5. The tamping unit of claim 1 wherein the vibrating drive is mounted centrally between the two supports.

* * * * *